US005906074A

United States Patent [19]

Bell

[11] Patent Number: 5,906,074

[45] Date of Patent: May 25, 1999

[54] GUTTER COVERING SYSTEM

[76] Inventor: Cedric Bell, 4 Somonauk Ct., Park Forest, Ill. 60466

[21] Appl. No.: 09/019,280

[22] Filed: Feb. 5, 1998

[51] Int. Cl.[6] ..... E04D 13/00

[52] U.S. Cl. ..... 52/12; 52/23; 52/3; 52/4

[58] Field of Search ..... 52/12, 23, 3, 4; 43/7, 134; 5/414; 87/53; 114/241; 54/80.4

[56] References Cited

U.S. PATENT DOCUMENTS

| | | | |
|---|---|---|---|
| 2,734,467 | 2/1956 | Steele | 108/30 |
| 3,023,544 | 3/1962 | Hughes | 50/5 |
| 4,841,686 | 6/1989 | Rees | 52/12 |
| 5,092,086 | 3/1992 | Rognsvog, Sr. | 52/12 |
| 5,095,666 | 3/1992 | Williams, Jr. | 52/11 |
| 5,678,359 | 10/1997 | Turner | 52/12 |
| 5,729,931 | 3/1998 | Wade | 52/12 |

*Primary Examiner*—Carl D. Friedman
*Assistant Examiner*—Nkeisha Maddox

[57] ABSTRACT

A new gutter covering system for keeping debris from accumulating in a gutter. The inventive device includes a length of net dimensioned for covering a gutter. The length of net is positioned over an open upper end of the gutter. The length of net has a long inboard edge, a long outboard edge, and opposing side edges. The inboard edge has a plurality of loops secured thereto and extending outwardly therefrom in a spaced relationship therealong. A plurality of side hooks are provided each having an elastic cord extending outwardly therefrom. Free ends of the elastic cords are secured to the outboard edge of the length of net in a spaced relationship therealong. The side hooks are extendable under a long outer side wall and a closed bottom end of the gutter and securing to a long inner side wall of the gutter. A pair of end hooks are provided with each having an elastic cord extending outwardly therefrom. The elastic cord of each end hook has a branched end for securement to opposing corners of the opposing side edges of the length of net. The end hooks are extendable under short end walls of the gutter and engaging the closed bottom end thereof.

1 Claim, 2 Drawing Sheets

GUTTER COVERING SYSTEM

BACKGROUND OF THE INVENTION

1. Field of the Invention

The present invention relates to gutter screens and more particularly pertains to a new gutter covering system for keeping debris from accumulating in a gutter.

2. Description of the Prior Art

The use of gutter screens is known in the prior art. More specifically, gutter screens heretofore devised and utilized are known to consist basically of familiar, expected and obvious structural configurations, notwithstanding the myriad of designs encompassed by the crowded prior art which have been developed for the fulfillment of countless objectives and requirements.

Known prior art gutter screens include U.S. Pat. No. 5,388,377 to Faulkner; U.S. Pat. No. 5,321,920 to Sichel; U.S. Pat. No. 5,271,192 to Nothum, Sr. et al.; U.S. Pat. No. 5,109,640 to Creson; U.S. Pat. No. 5,072,551 to Manoogian, Jr.; and U.S. Pat. No. Des. 338,948 to Fox.

While these devices fulfill their respective, particular objectives and requirements, the aforementioned patents do not disclose a new gutter covering system. The inventive device includes a length of net dimensioned for covering a gutter. The length of net is positioned over an open upper end of the gutter. The length of net has a long inboard edge, a long outboard edge, and opposing side edges. The inboard edge has a plurality of loops secured thereto and extending outwardly therefrom in a spaced relationship therealong. A plurality of side hooks are provided each having an elastic cord extending outwardly therefrom. Free ends of the elastic cords are secured to the outboard edge of the length of net in a spaced relationship therealong. The side hooks are extendable under a long outer side wall and a closed bottom end of the gutter and securing to a long inner side wall of the gutter. A pair of end hooks are provided with each having an elastic cord extending outwardly therefrom. The elastic cord of each end hook has a branched end for securement to opposing corners of the opposing side edges of the length of net. The end hooks are extendable under short end walls of the gutter and engaging the closed bottom end thereof.

In these respects, the gutter covering system according to the present invention substantially departs from the conventional concepts and designs of the prior art, and in so doing provides an apparatus primarily developed for the purpose of keeping debris from accumulating in a gutter.

SUMMARY OF THE INVENTION

In view of the foregoing disadvantages inherent in the known types of gutter screens now present in the prior art, the present invention provides a new gutter covering system construction wherein the same can be utilized for keeping debris from accumulating in a gutter.

The general purpose of the present invention, which will be described subsequently in greater detail, is to provide a new gutter covering system apparatus and method which has many of the advantages of the gutter screens mentioned heretofore and many novel features that result in a new gutter covering system which is not anticipated, rendered obvious, suggested, or even implied by any of the prior art gutter screens, either alone or in any combination thereof.

To attain this, the present invention generally comprises a length of net dimensioned for covering a gutter. The length of net is positioned over an open upper end of the gutter. The length of net has a long inboard edge, a long outboard edge, and opposing side edges. The inboard edge has a plurality of loops secured thereto and extending outwardly therefrom in a spaced relationship therealong. A plurality of side hooks are provided each having an elastic cord extending outwardly therefrom. Free ends of the elastic cords are secured to the outboard edge of the length of net in a spaced relationship therealong. The side hooks are extendable under a long outer side wall and a closed bottom end of the gutter and securing to a long inner side wall of the gutter. A pair of end hooks are provided with each having an elastic cord extending outwardly therefrom. The elastic cord of each end hook has a branched end for securement to opposing corners of the opposing side edges of the length of net. The end hooks are extendable under short end walls of the gutter and engaging the closed bottom end thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new gutter covering system apparatus and method which has many of the advantages of the gutter screens mentioned heretofore and many novel features that result in a new gutter covering system which is not anticipated, rendered obvious, suggested, or even implied by any of the prior art gutter screens, either alone or in any combination thereof.

It is another object of the present invention to provide a new gutter covering system which may be easily and efficiently manufactured and marketed.

It is a further object of the present invention to provide a new gutter covering system which is of a durable and reliable construction.

An even further object of the present invention is to provide a new gutter covering system which is susceptible of a low cost of manufacture with regard to both materials and labor, and which accordingly is then susceptible of low prices of sale to the consuming public, thereby making such gutter covering system economically available to the buying public.

Still yet another object of the present invention is to provide a new gutter covering system which provides in the apparatuses and methods of the prior art some of the advantages thereof, while simultaneously overcoming some of the disadvantages normally associated therewith.

Still another object of the present invention is to provide a new gutter covering system for keeping debris from accumulating in a gutter.

Yet another object of the present invention is to provide a new gutter covering system which includes a length of net dimensioned for covering a gutter. The length of net is positioned over an open upper end of the gutter. The length of net has a long inboard edge, a long outboard edge, and opposing side edges. The inboard edge has a plurality of loops secured thereto and extending outwardly therefrom in a spaced relationship therealong. A plurality of side hooks are provided each having an elastic cord extending outwardly therefrom. Free ends of the elastic cords are secured to the outboard edge of the length of net in a spaced relationship therealong. The side hooks are extendable under a long outer side wall and a closed bottom end of the gutter and securing to a long inner side wall of the gutter. A pair of end hooks are provided with each having an elastic cord extending outwardly therefrom. The elastic cord of each end hook has a branched end for securement to opposing corners of the opposing side edges of the length of net. The end hooks are extendable under short end walls of the gutter and engaging the closed bottom end thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
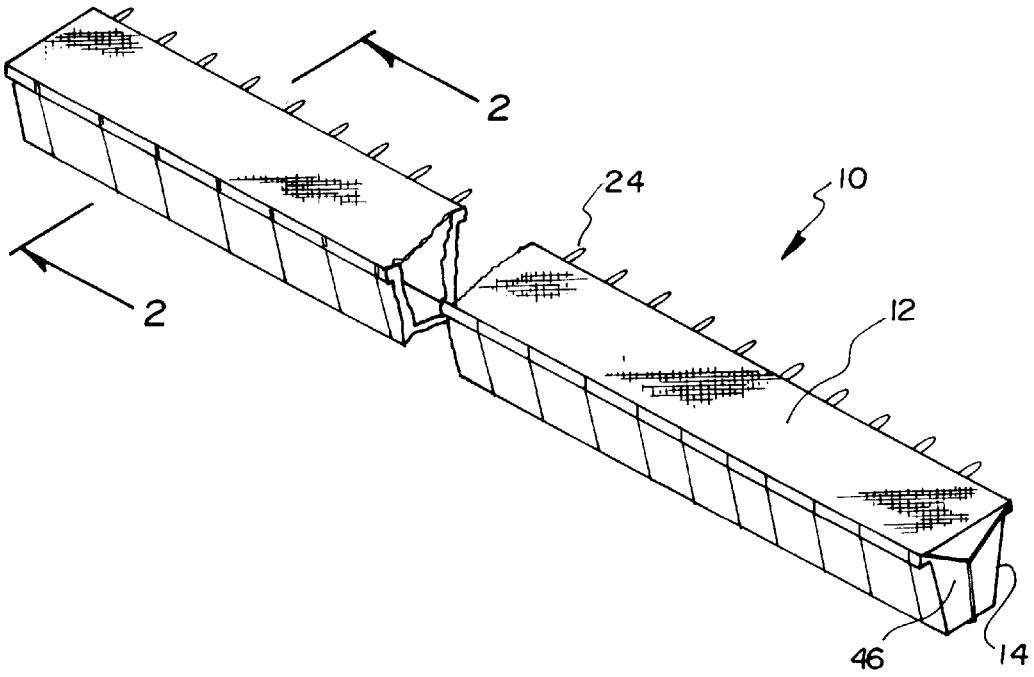
FIG. 1 is a perspective view of a new gutter covering system according to the present invention.
Figure 2:
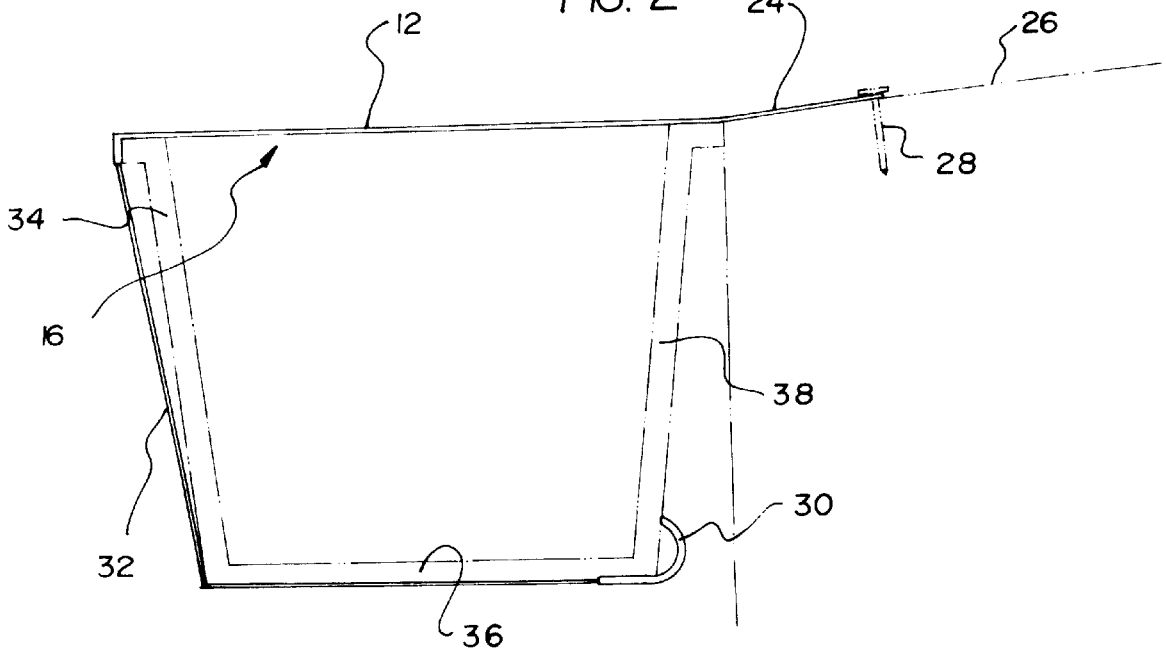
FIG. 2 is a cross-sectional side view of the present invention shown in place over a gutter as taken along line 2—2 of FIG. 1.
Figure 4:
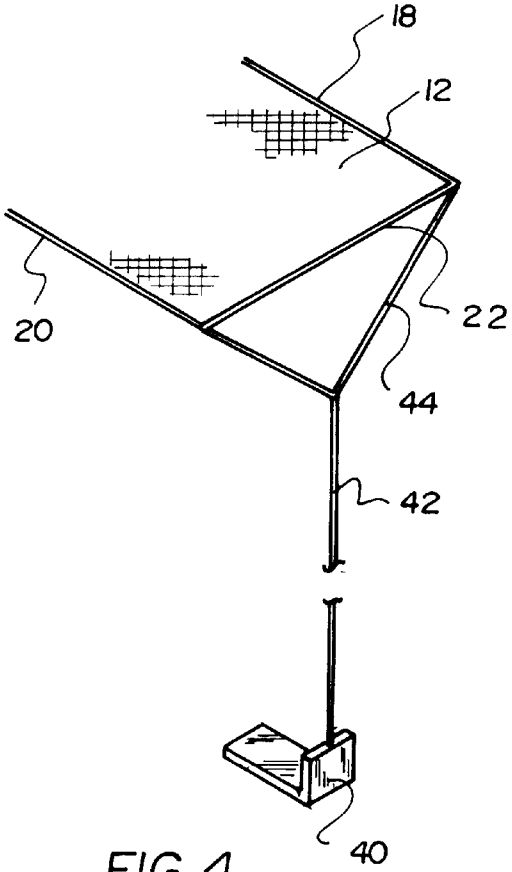
FIG. 4 is a sectional perspective view of the present invention.
Figure 3:
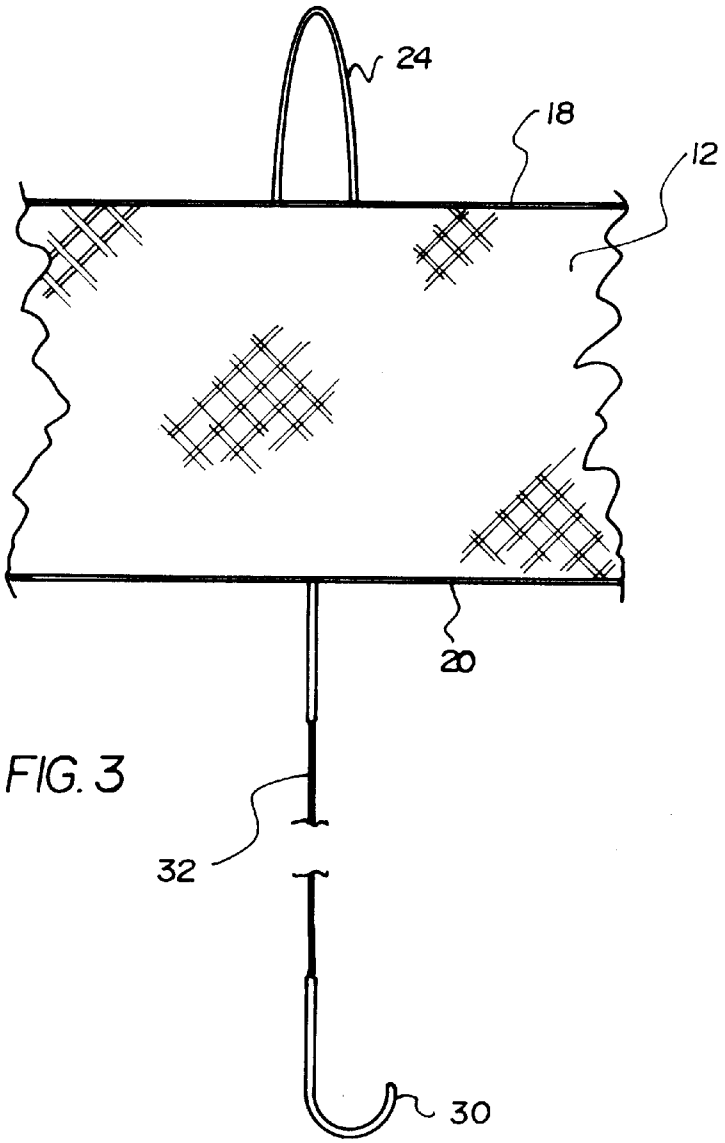
FIG. 3 is a sectional top plan view of the present invention.

With reference now to the drawings, and in particular to FIGS. 1 through 4 thereof, a new gutter covering system embodying the principles and concepts of the present invention and generally designated by the reference numeral 10 will be described.

As best illustrated in FIGS. 1 through 4, the gutter covering system 10 comprises a length of net 12 dimensioned for covering a gutter 14. The length of net 12 is positioned over an open upper end 16 of the gutter 14. The length of net 12 has a long inboard edge 18, a long outboard edge 20, and opposing side edges 22. The inboard edge 18 has a plurality of loops 24 secured thereto and extending outwardly therefrom in a spaced relationship therealong. The plurality of loops 24 are positioned along a roof edge 26 and are held in place by tacks 28 driven into the roof. This will secure the length of net in place with respect to the roof.

A plurality of side hooks 30 are provided each having an elastic cord 32 extending outwardly therefrom. Free ends of the elastic cords 32 are secured to the outboard edge 20 of the length of net 12 in a spaced relationship therealong. The side hooks 30 are extendable under a long outer side wall 34 and a closed bottom end 36 of the gutter and securing to a long inner side wall 38 of the gutter 14. Note FIG. 2.

A pair of end hooks 40 are provided with each having an elastic cord 42 extending outwardly therefrom. The elastic cord 42 of each end hook 40 has a branched end 44 for securement to opposing corners of the opposing side edges 22 of the length of net 12. The end hooks 40 are extendable under short end walls 46 of the gutter 14 and engage the closed bottom end 36 of the gutter 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new gutter covering system for keeping debris from accumulating in a gutter comprising, in combination:

a length of net dimensioned for covering a gutter, the length of net for positioned over an open upper end of the gutter, the length of net having a long inboard edge, a long outboard edge, and opposing side edges, the inboard edge having a plurality of loops secured thereto and extending outwardly therefrom in a spaced relationship therealong;

a plurality of side hooks each having an elastic cord extending outwardly therefrom, free ends of the elastic cords secured to the outboard edge of the length of net in a spaced relationship therealong, the side hooks being extendable under a long outer side wall and a closed bottom end of the gutter and for securing to a long inner side wall of the gutter; and a pair of end hooks each having an elastic cord extending outwardly therefrom, the elastic cord of each end hook having a branched end securing to opposing corners of the opposing side edges of the length of net, the end hooks being adapted for extending under short end walls of the gutter for engaging the closed bottom end thereof.

* * * * *